US012392572B2

(12) United States Patent
Wehring et al.

(10) Patent No.: US 12,392,572 B2
(45) Date of Patent: Aug. 19, 2025

(54) FIREARM SPADE GRIP ASSEMBLY

(71) Applicants: Justin Wehring, Clute, TX (US); Gerald T. Schubert, II, Carrollton, GA (US); Gerald T. Schubert, III, Carrollton, GA (US)

(72) Inventors: Justin Wehring, Clute, TX (US); Gerald T. Schubert, II, Carrollton, GA (US); Gerald T. Schubert, III, Carrollton, GA (US)

( * ) Notice: Subject to any disclaimer, the term of this patent is extended or adjusted under 35 U.S.C. 154(b) by 6 days.

(21) Appl. No.: 18/591,227

(22) Filed: Feb. 29, 2024

(65) Prior Publication Data

US 2024/0295377 A1 Sep. 5, 2024

Related U.S. Application Data

(60) Provisional application No. 63/487,928, filed on Mar. 2, 2023.

(51) Int. Cl.

| | |
|---|---|
| ***F41A 19/10*** | (2006.01) |
| ***F41A 19/07*** | (2006.01) |
| ***F41A 23/24*** | (2006.01) |

(52) U.S. Cl.

CPC ..... *F41A 23/24* (2013.01); *F41A 19/07* (2013.01); *F41A 19/10* (2013.01)

(58) Field of Classification Search

CPC ..... F41A 19/07; F41A 19/09; F41A 19/10

See application file for complete search history.

(56) References Cited

U.S. PATENT DOCUMENTS

| | | | | |
|---|---|---|---|---|
| 8,434,397 | B1 * | 5/2013 | Deckard | F41A 9/60 89/37.16 |
| 12,117,258 | B1 * | 10/2024 | Archer | F41A 27/28 |
| 2025/0123068 | A1 * | 4/2025 | Barnhart | F41A 19/10 |

* cited by examiner

*Primary Examiner* — J. Woodrow Eldred

(74) *Attorney, Agent, or Firm* — Snell & Wilmer L.L.P.

(57) ABSTRACT

A firearm spade grip assembly can comprise a firearm, paddle trigger assembly, and/or a mounting system. A paddle trigger assembly can comprise a base spanning between and comprising a base forward end and a base aft end; a paddle trigger coupled to the base; a trigger actuator coupled to the base; and/or an actuator housing coupled to and extending forward from the base, wherein the trigger actuator is disposed at least partially within the actuator housing. Movement of the paddle trigger can be configured to translate the trigger actuator. A mounting system of a firearm spade grip assembly can comprise a mounting base configured to couple to a firearm receiver base or a firearm receiver of the firearm.

18 Claims, 13 Drawing Sheets

FIREARM SPADE GRIP ASSEMBLY

CROSS-REFERENCE TO RELATED APPLICATIONS

This application is a nonprovisional of, and claims priority to and the benefit of, U.S. Provisional Patent Application No. 63/487,928, filed Mar. 2, 2023 and entitled "FIREARM SPADE GRIP ASSEMBLY." The disclosure of the foregoing application is incorporated herein by reference, including but not limited to those portions that specifically appear hereinafter, but except for any subject matter disclaimers or disavowals, and except to the extent that the incorporated material is inconsistent with the express disclosure herein, in which case the language in this disclosure shall control.

TECHNICAL FIELD

The present disclosure relates generally to firearm actuating and mounting systems and methods.

BACKGROUND

Firearms, for example, rifles or light or medium machine gun-style firearms, can be large, heavy, and unwieldy, making effective use thereof difficult for an individual. Such firearms can be impractical or difficult to carry, shoulder, and/or fire accurately and effectively given the significant size, weight, and shape. Therefore, systems and methods for mounting such firearms to decrease the burden on the user with regard to supporting, stabilizing, gripping, shouldering, and/or steadying, while allowing convenient firearm actuation and firing, may be desired.

SUMMARY OF THE DISCLOSURE

The present disclosure relates to a firearm spade grip assembly. In various examples, a firearm spade grip assembly can comprise a firearm, a paddle trigger assembly, and/or a mounting system. In various examples, a paddle trigger assembly can comprise a base spanning between and comprising a base forward end and a base aft end; a paddle trigger coupled to the base; a trigger actuator coupled to the base; and/or an actuator housing coupled to and extending forward from the base, wherein the trigger actuator is disposed at least partially within the actuator housing. In various examples, a portion of the trigger actuator can extend from the base forward end, wherein the trigger actuator comprises an actuator aft end coupled to the paddle trigger and a traverse block forward of the actuator aft end configured to engage and pull a firearm trigger of a firearm in an aft direction in response to translation of the trigger actuator, wherein movement of the paddle trigger can be configured to translate the trigger actuator. In various examples, the actuator housing can be configured to couple to at least one of a firearm receiver base or a firearm receiver of the firearm. In various examples, the actuator housing can be configured to receive a firearm trigger of the firearm therein. In various examples, a firearm spade grip assembly and/or paddle trigger assembly can further comprise a paddle trigger safety configured to prevent an actuating movement of the paddle trigger in response to being engaged.

In various examples, a firearm spade grip assembly and/or paddle trigger assembly can further comprise a fastener disposed through a bottom surface of the actuator housing that is configured to couple the actuator housing to the firearm. The fastener can be configured to be disposed in a handle fastener receptacle in the firearm. In various examples, a firearm spade grip assembly and/or paddle trigger assembly can further comprise a paddle trigger housing coupled to the base aft end, wherein the paddle trigger can be coupled to the base via the paddle trigger housing. In various examples, the base forward end comprises a void configured to receive a buffer assembly of the firearm.

In various examples, a mounting system can comprise a mounting base configured to couple to the firearm receiver base or the firearm receiver of the firearm; a brass catch coupled to the mounting base comprising a brass catch inlet and a brass catch chute, wherein the brass catch inlet can be configured to align with an ejection port of the firearm, and wherein the brass catch inlet and the brass catch chute are in fluid communication; and/or a mounting support arm coupled to the mounting base. The mounting support arm can comprise a foundation joint and a mount joint, wherein the foundation joint can be configured to allow the firearm to move about a first pivot point, and wherein the mount joint can be configured to allow the firearm to move about a second pivot point. In various examples, a mounting system can further comprise a charging system coupled to the mounting base and comprising a charging block configured to couple to a charging handle of the firearm and a guiderail configured to allow the charging block to translate in the aft direction or a forward direction to charge the firearm.

In various examples, a firearm spade grip assembly can comprise a firearm comprising at least one of a firearm receiver base or a firearm receiver, and a firearm trigger; and/or a paddle trigger assembly coupled to the firearm. The paddle trigger assembly can comprise a base, comprising a base forward end and a base aft end, wherein the base can be coupled to an aft end of the firearm receiver base or an aft end of the firearm receiver; a paddle trigger coupled to the base; a trigger actuator coupled to the paddle trigger and configured to actuate the firearm trigger in response to movement of the paddle trigger; and/or an actuator housing coupled to and extending from the base forward end. The actuator housing can be coupled to the firearm receiver base or the firearm receiver such that the firearm trigger of the firearm is disposed at least partially in the actuator housing. In various examples, the firearm trigger can be completely enclosed between the firearm and the actuator housing. In various examples, the paddle trigger assembly can be coupled to the firearm at least partially by a fastener disposed through a bottom surface of the actuator housing and into a handle fastener receptacle in the firearm. In various examples, the assembly can further comprise a buffer assembly coupled to the firearm receiver, wherein the base forward end can be coupled to the buffer assembly.

In various examples, a firearm spade grip assembly can further comprise a mounting system coupled to the firearm and configured to couple the firearm to a surface. The mounting system can comprise a mounting support arm comprising a foundation joint and a mount joint, as discussed herein.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures. Elements with like element numbering throughout the figures are intended to be the same.

DETAILED DESCRIPTION

Figure 1A:
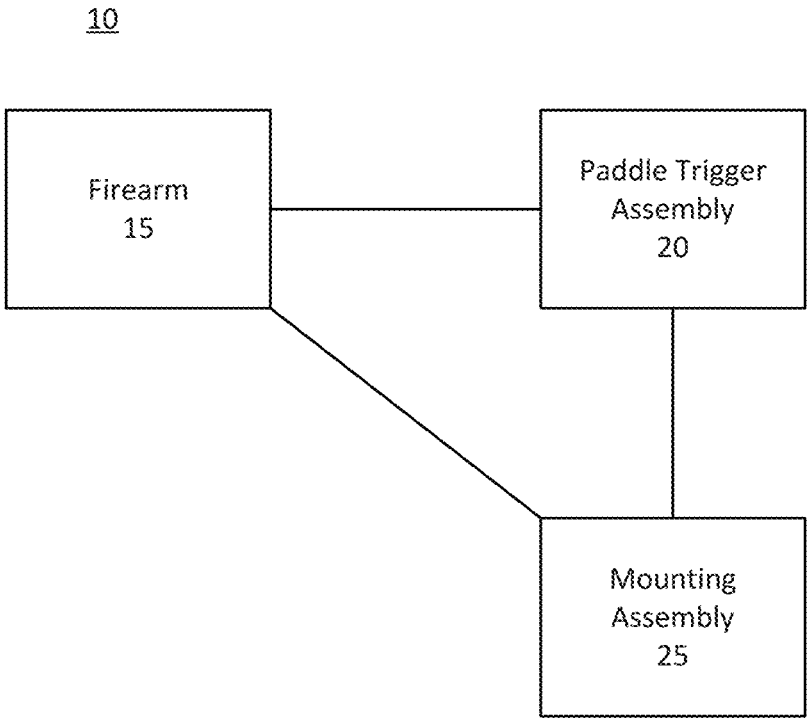
FIG. 1A depicts a block diagram of the components of a firearm spade grip assembly, in accordance with various examples.

All ranges may include the upper and lower values, and all ranges and ratio limits disclosed herein may be combined. It is to be understood that unless specifically stated otherwise, references to "a," "an," and/or "the" may include one or more than one and that reference to an item in the singular may also include the item in the plural. When referring to components of systems discussed herein, the term "coupled" refers to direct coupling or indirect coupling with other intervening elements, as appropriate. Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item. Further, reference to, e.g., a "first" item and a "second" item, or the coupling thereof, does not mean that there are no intervening items, and such intervening items may be present.

The detailed description of various examples herein makes reference to the accompanying drawings, which show various examples by way of illustration. While these various examples are described in sufficient detail to enable those skilled in the art to practice the disclosure, it should be understood that other examples may be realized and that logical, chemical, and mechanical changes may be made without departing from the scope of the disclosure. Thus, the detailed description herein is presented for purposes of illustration only and not of limitation. For example, the steps recited in any of the method or process descriptions may be executed in any suitable combination and/or order and are not necessarily limited to the order or combination presented. Furthermore, any reference to singular includes plural examples, and any reference to more than one component or step may include a singular component or step. Also, any reference to attached, fixed, connected, or the like may include permanent, removable, temporary, partial, full, and/or any other possible attachment option. Additionally, any reference to without contact (or similar phrases) may also include reduced contact or minimal contact.

As used herein, the term "aft," "rear," or the like refers to the direction associated with a butt (e.g., the back or rear end) of a firearm or the breech of a firearm barrel, or generally, to the direction of recoil in response to firing a round or cartridge in a firearm. As used herein, the term "forward," "front," or the like refers to the direction associated with a muzzle (e.g., the front end) of the firearm or barrel, or generally, to the direction of flight of a projectile (e.g., a bullet) fired from a firearm. An A-R axis has been included to illustrate the axial (A) and radial (R) directions. The negative radial direction can be the direction toward the center of a firearm barrel bore, and the positive radial direction can be the direction away from the center of a firearm barrel bore. The forward and aft directions are axial directions. As an example, an axial direction can be along an axis, or parallel to an axis, along which a bullet will travel in response to being fired from a firearm.

In various examples, a firearm can be incorporated into a firearm spade grip assembly by the original equipment manufacturer (e.g., by firearm spade grip assembly parts being integral and/or monolithic with other firearm parts such as a receiver, buffer assembly, trigger housing, and/or the like), or the other components of a firearm spade grip assembly can be retrofitted to the firearm by coupling such components to the firearm. A firearm spade grip assembly can be configured to mount a firearm on a surface (e.g., on a platform or on or within a vehicle such as an automobile, airplane, helicopter, watercraft, and/or the like), allow the user to grip the firearm using one or two hands (e.g., by grasping one or two handles), and/or activate or fire the firearm by translating an actuator disposed in an aft portion of the firearm and/or firearm spade grip assembly.

In various examples, with reference to FIG. 1A, a firearm spade grip assembly 10 can comprise a firearm 15, a paddle trigger assembly 20, and/or a mounting system 25. The mounting system can be configured to mount the firearm to a surface, and/or allow the firearm to pivot (i.e., aim) in various directions, as discussed herein. The paddle trigger assembly can be configured to allow the user to grip, pivot/move, aim, and actuate (i.e., fire) the firearm from a convenient location (e.g., from behind or at an aft portion of the firearm and/or firearm spade grip assembly). For example, with reference to FIG. 1B, spade grip assembly 100 comprises a paddle trigger assembly 200 and a mounting system 400 coupled to a firearm (coupled to firearm receiver base 60). Firearm receiver base 60 may belong to an FN brand M249 SAW light machine gun, but it should be understood that the examples discussed herein can be applied to any suitable firearm. Firearm receiver base 60 can be comprised in and/or coupled to the firearm receiver. Therefore, anything coupled to firearm receiver base 60 can be deemed as coupled to the firearm receiver. In various examples, paddle trigger assembly 200 can be directly coupled to firearm receiver base 60 and/or a firearm receiver (or other suitable component of a firearm). In various examples, paddle trigger assembly 200 can be coupled to firearm receiver base 60 or a firearm receiver at least partially via another component of the firearm, such as firearm trigger housing 72, which is coupled to firearm receiver base 60.

Figure 1B:
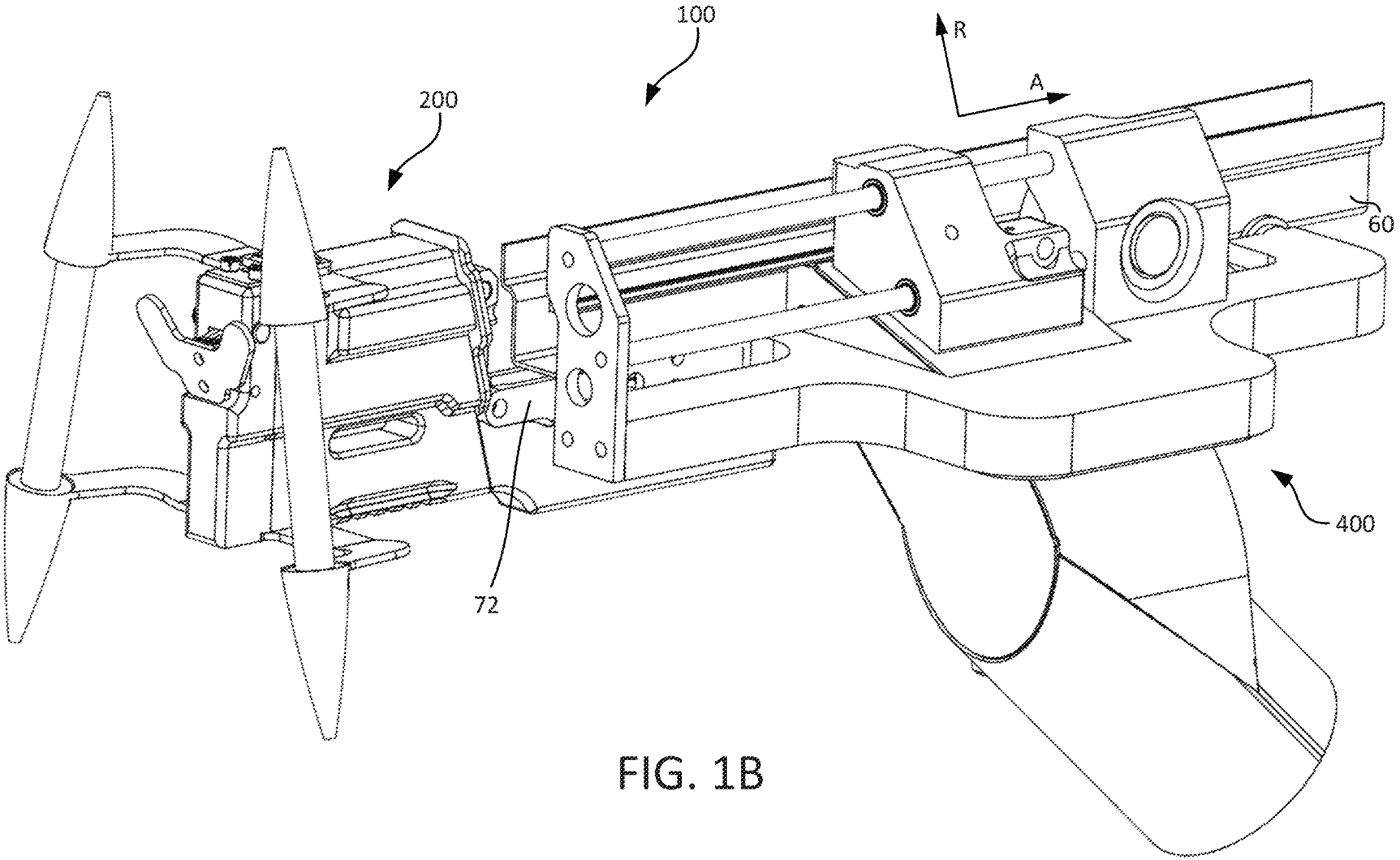
FIG. 1B illustrates a firearm spade grip assembly, in accordance with various examples.
Figure 2A:
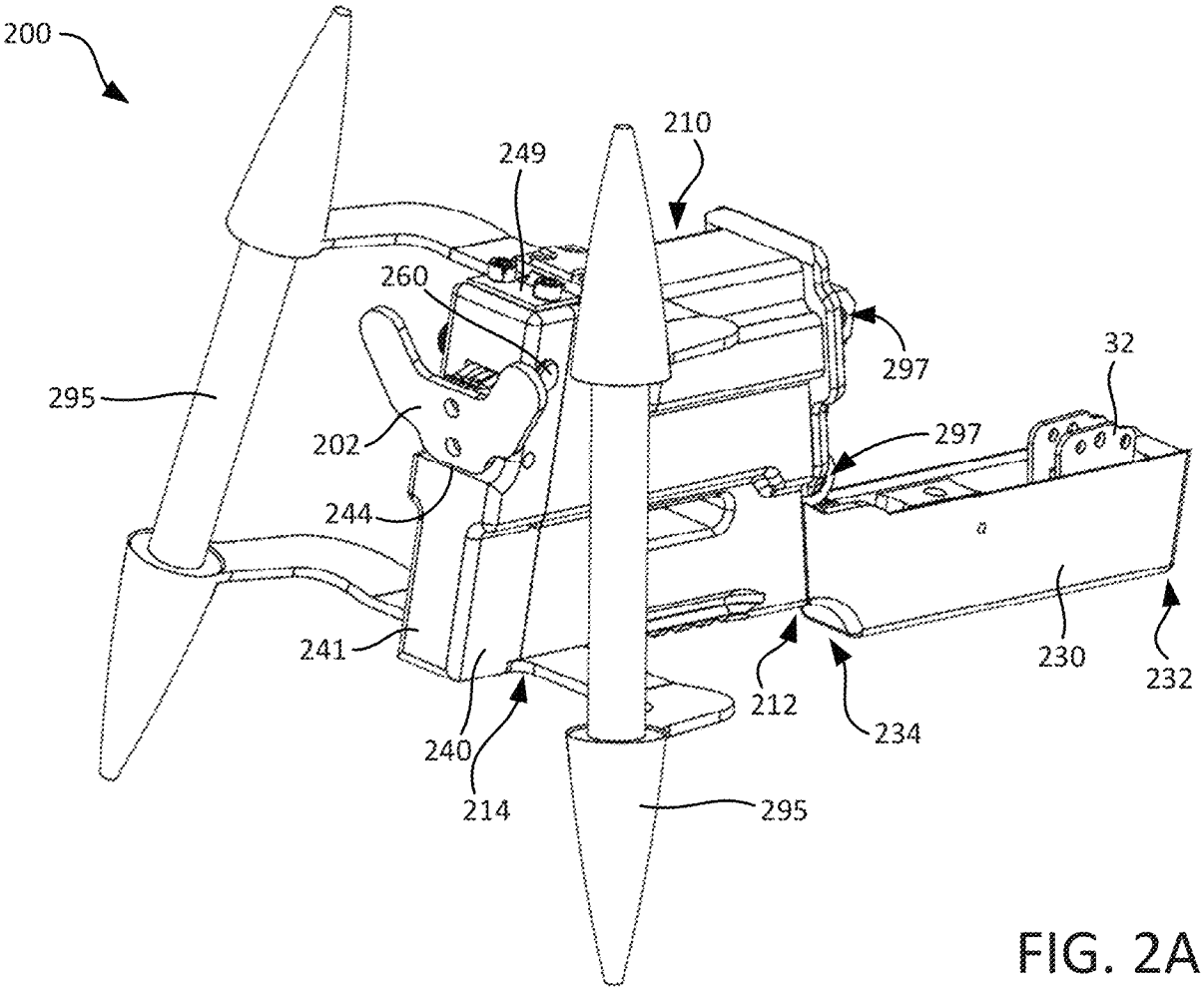
FIG. 2A illustrates a perspective view of a paddle trigger assembly for the firearm spade grip assembly of FIG. 1B, in accordance with various examples.
Figure 2B:
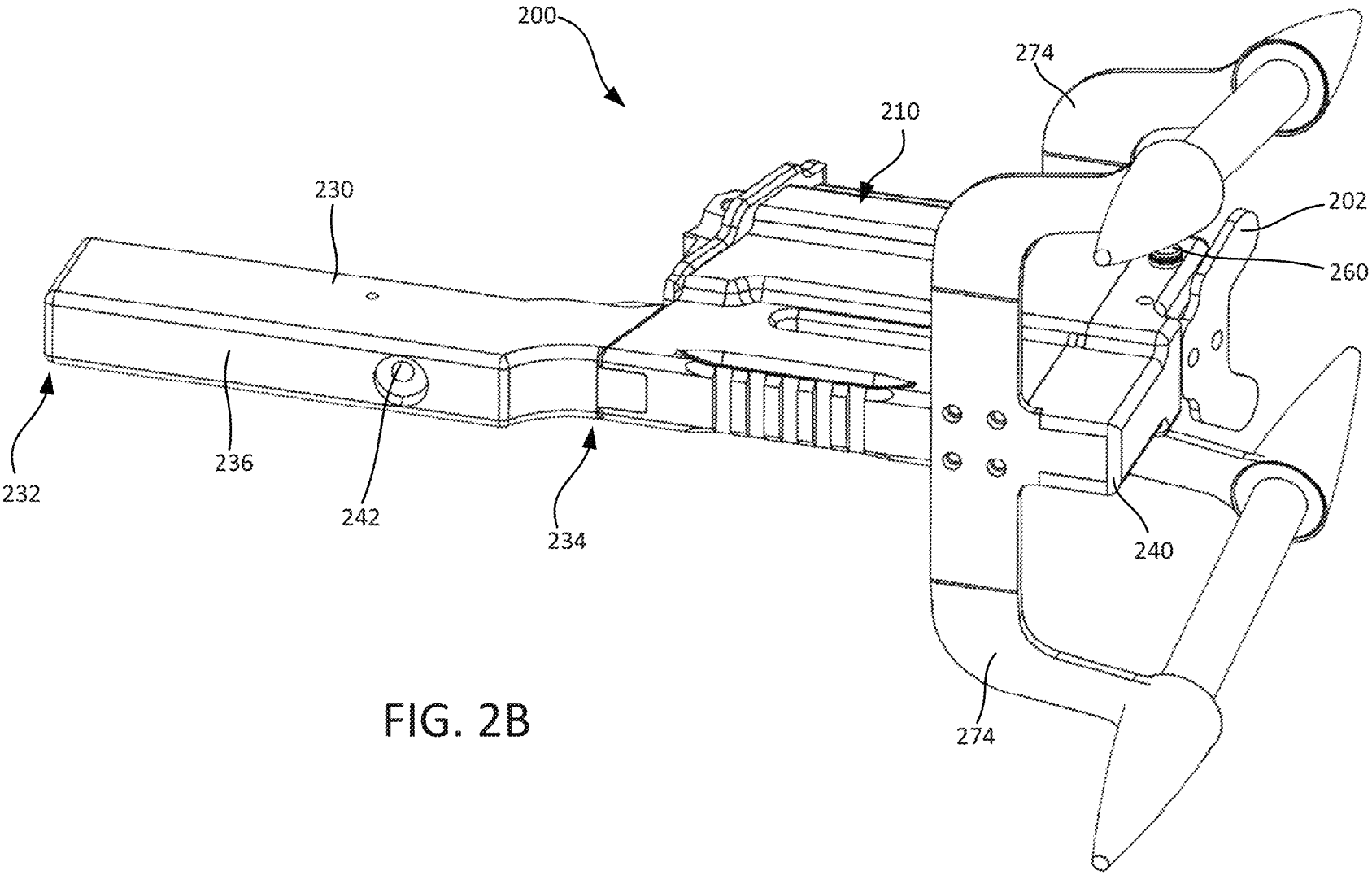
FIG. 2B illustrates a bottom perspective view of the paddle trigger assembly of FIG. 2A, in accordance with various examples.
Figure 2C:
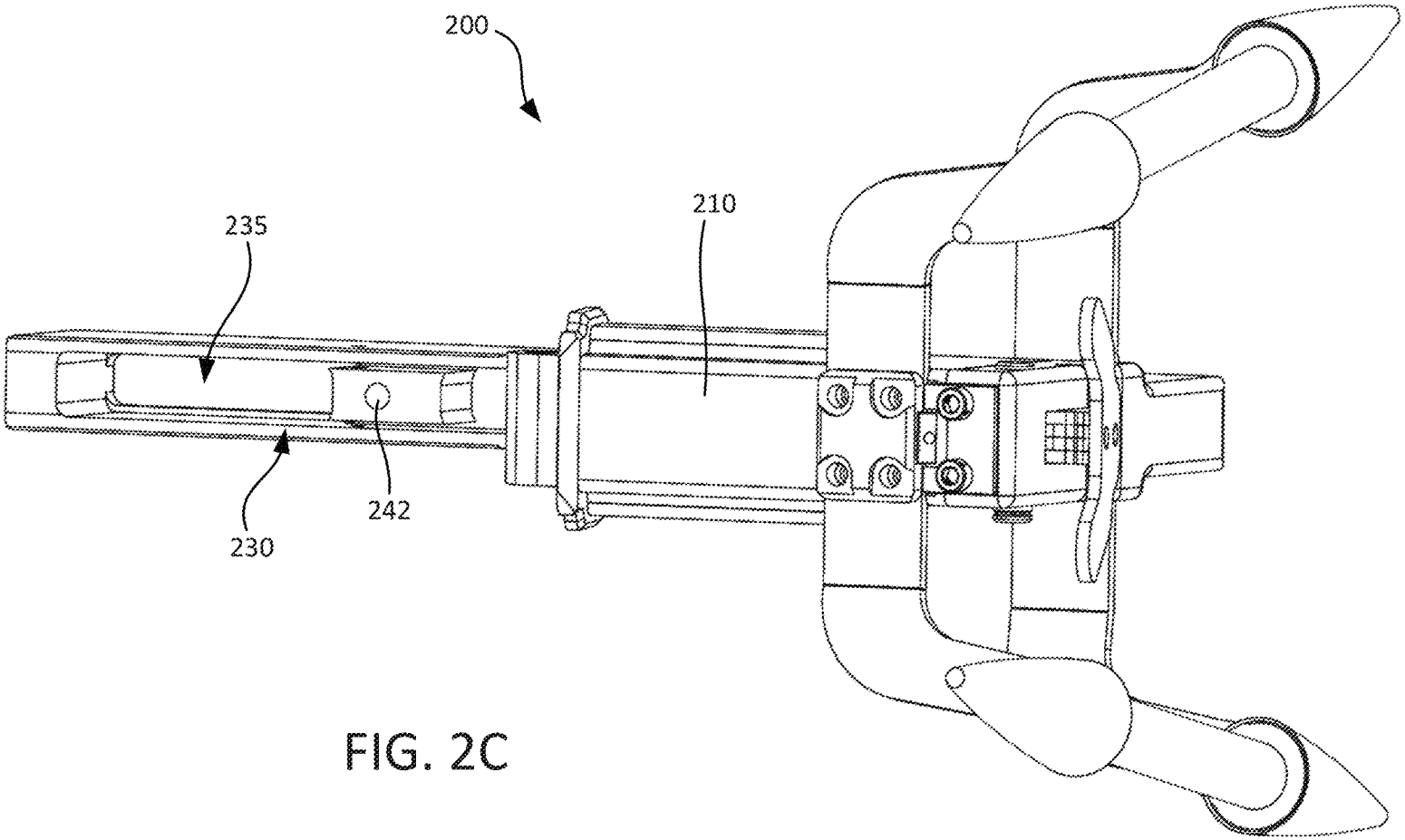
FIG. 2C illustrates a top view of the paddle trigger assembly of FIG. 2A, in accordance with various examples.

With additional reference to FIGS. 2A-2C, paddle trigger assembly 200 from FIG. 1B is depicted, in accordance with various examples. In various examples, a paddle trigger assembly can comprise a paddle trigger 202 (e.g., a butterfly trigger having wings 203 depicted in FIG. 3A) coupled to a trigger actuator. In response to the paddle trigger being actuated (e.g., being pressed, pivoted, or otherwise translated or moved), the trigger actuator can actuate the firearm (e.g., by pulling the trigger of the firearm), thus firing the firearm. For example, with additional reference to FIGS. 6A and 6B, paddle trigger assembly 200 can comprise paddle trigger 602 (paddle trigger 202 in FIGS. 2A-2C) coupled to trigger actuator 650. Trigger actuator 650 can comprise an actuator aft end 652 coupled to paddle trigger bar 605 (paddle trigger bar 205 in FIG. 3B) and/or paddle trigger 602 and a forward end 654 extending forward. Trigger actuator 650 can further comprise one or more traverse blocks (e.g., traverse block 655A) configured to engage firearm trigger 632 (firearm trigger 32 in FIG. 2A) and pull firearm trigger 632 in an aft direction in response to paddle trigger 602 being engaged, for example, by being pressed toward a paddle trigger housing (e.g., in a forward direction), thus firing the firearm. Traverse blocks 655A,B can span substantially perpendicular to the forward-aft direction (in this context, "substantially" means plus or minus 30 degrees). Traverse block 655B may be configured to push firearm trigger 632 in a forward direction in response to paddle trigger 602 being disengaged, to cease firing the firearm and/or reset the trigger to fire another round. A spring 651 can be coupled to and/or engaged with trigger actuator 650, spring 651 being biased toward the unengaged position (i.e., the position of the trigger actuator that does not pull the firearm trigger and fire the firearm). Thus, with the paddle trigger and paddle trigger assembly starting in the unengaged position 600A (not engaging firearm trigger 632), in response to paddle trigger 602 being engaged (e.g., pressed in a forward direction), paddle trigger bar 605 can pivot (e.g., about pivot point 609, which can be a pin, bolt, or the like), causing trigger actuator 650 to translate in an aft direction into an engaged position 600B, compressing spring 651 against its bias. In response, traverse bar 655A can engage firearm trigger 632, thus pulling or engaging firearm trigger 632 in an aft direction to fire the firearm. In response to paddle trigger 602 being released, the spring bias of spring 651 can return the paddle trigger and the trigger actuator to unengaged position 600A (e.g., by translating trigger actuator 650 in a forward direction). When unengaged, traverse block 655A can rest against or proximate to firearm trigger 632 (e.g., within one or two millimeters), without putting pressure (e.g., aftward pressure) on firearm trigger 632.

In various examples, a paddle trigger assembly can comprise an actuator housing in which the trigger actuator can be at least partially disposed and/or enclosed. For example, paddle trigger assembly 200 can comprise actuator housing 230 spanning between a forward end 232 and an aft end 234. Actuator housing 230 can at least partially enclosing trigger actuator 650 therein. Firearm trigger 32 (or 632) can be at least partially disposed in actuator housing 230 within trigger void 235. When installed or coupled to the firearm (e.g., to firearm receiver base 60 and/or trigger housing 72), paddle trigger assembly 200 can fully enclose the forward end of trigger actuator 650 and/or firearm trigger 32 (or 632). Such a configuration provides a safety feature configured to prevent or mitigate the risk of accidental actuation of the firearm trigger by bumping or otherwise accidentally causing trigger actuator 650 and/or firearm trigger 32 to move and fire the firearm.

Figure 6A:
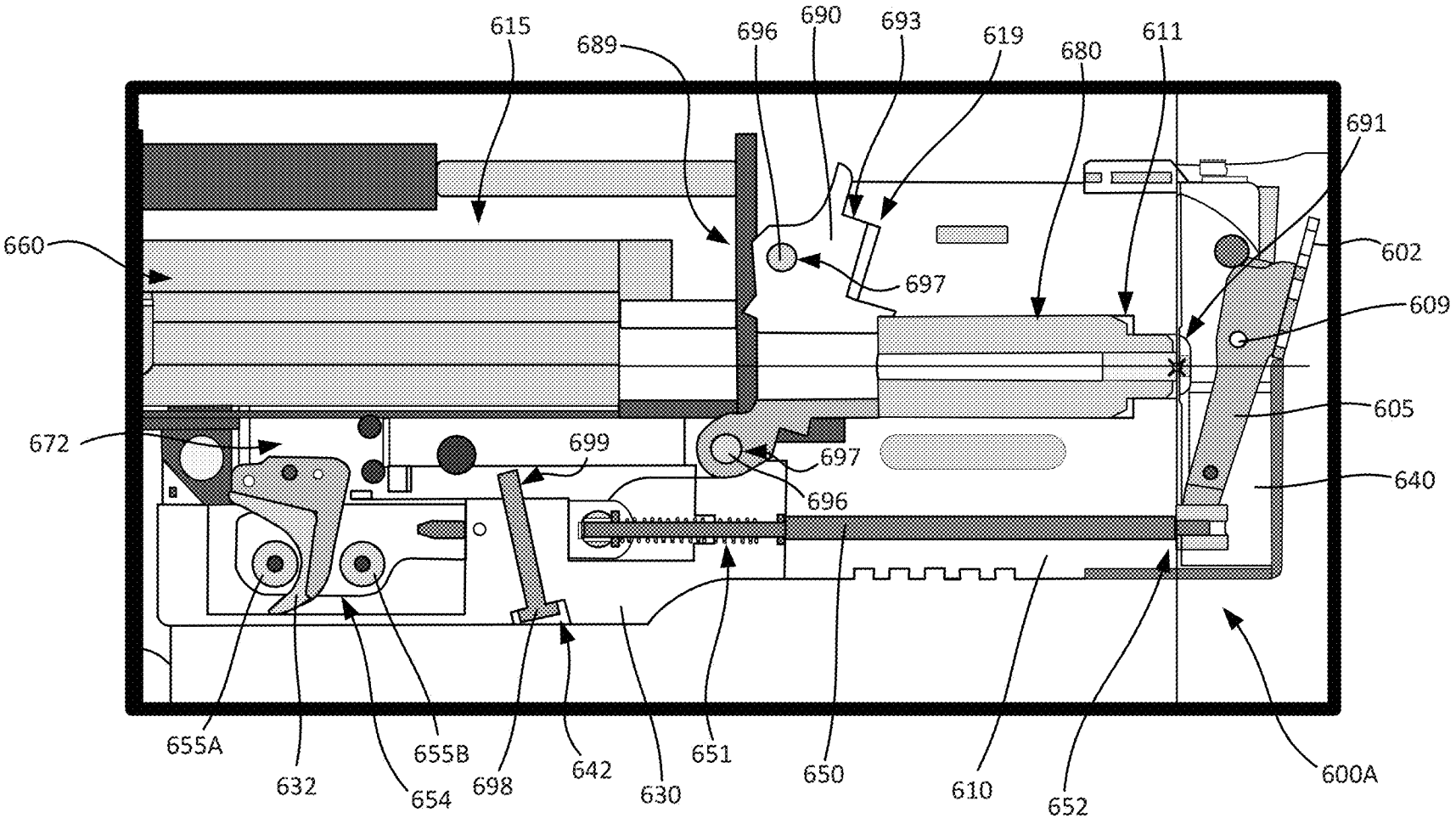
FIG. 6A illustrates a cross-sectional side view of a paddle trigger assembly coupled to a firearm in an unengaged position, in accordance with various examples.
Figure 6B:
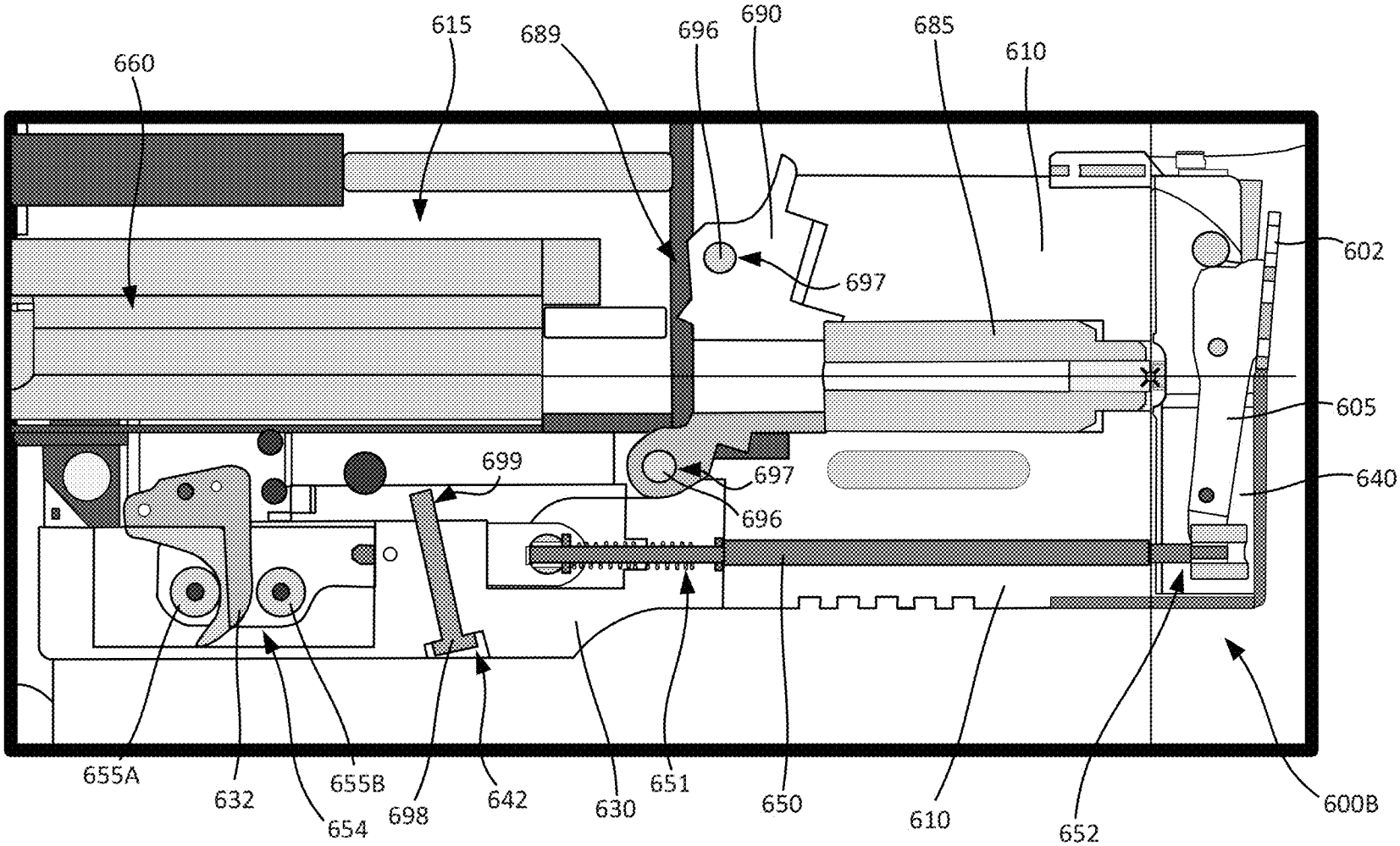
FIG. 6B illustrates a cross-sectional side view of a paddle trigger assembly coupled to a firearm in an engaged position, in accordance with various examples.

In various examples, an actuator housing can be coupled to a firearm in any suitable manner. For example, an actuator housing can be coupled to a firearm receiver and/or trigger housing via tight fit, sliding an actuator housing onto the respective firearm component (e.g., by complementary rails), an adhesive, and/or a fastener(s). With reference to paddle trigger assembly 200, actuator housing 230 can be coupled to the firearm receiver, firearm receiver base 60, and/or trigger housing 72 via a fastener being disposed through a coupling void 242 disposed in a bottom surface 236 of actuator housing 230. The fastener (e.g., a screw or bolt comprising threading) can pass through actuator housing 230 and be disposed in trigger housing 72, firearm receiver base 60, and/or the firearm receiver by screwing into threading complementary to the fastener threading. The complementary threading in the trigger housing 72, firearm receiver base 60, and/or the firearm receiver can be in a firearm handle fastener receptable configured to fasten a firearm handle and/or trigger guard to the firearm (e.g., at trigger housing 72 and/or firearm receiver base 60). As shown in FIGS. 6A and 6B, actuator housing 630 (similar to actuator housing 230) can be coupled to the firearm receiver or receiver base 660 and/or trigger housing 672 via a fastener 698 being disposed through a coupling void 642 disposed in a bottom surface of actuator housing 630. The fastener (e.g., a screw or bolt comprising threading) can pass through actuator housing 630 and be disposed in trigger housing 672, firearm receiver base 660, and/or the firearm receiver by screwing into threading complementary to the fastener threading. The complementary threading in the trigger housing 672, firearm receiver base 660, and/or the firearm receiver can be in a firearm handle fastener receptable (e.g., firearm coupling void 699) configured to fasten a firearm handle and/or trigger guard to the firearm (e.g., at trigger housing 672 and/or firearm receiver base 660). In various examples, the actuator housing can be coupled to a firearm at a location at which the handle and/or trigger guard for the firearm is configured to be coupled.

In various examples, a paddle trigger assembly can comprise a paddle trigger housing configured to couple to and/or mount the paddle trigger and/or house other paddle trigger components. In various examples, the paddle trigger housing can be coupled to the actuator housing, and the actuator housing can extend in the forward direction from the paddle trigger housing. In various examples, paddle trigger assembly 200 comprises paddle trigger housing 240 to which paddle trigger 202 can couple. Paddle trigger housing 240 (640 in FIGS. 6A,B) can be coupled to actuator housing 230 via a base 210 disposed therebetween. Paddle trigger 202 can be coupled to paddle trigger housing 240 on an aft surface 241, and can be disposed on and/or contact a ledge 244, on which paddle trigger 202 can pivot to be engaged or disengaged.

Figure 3A:
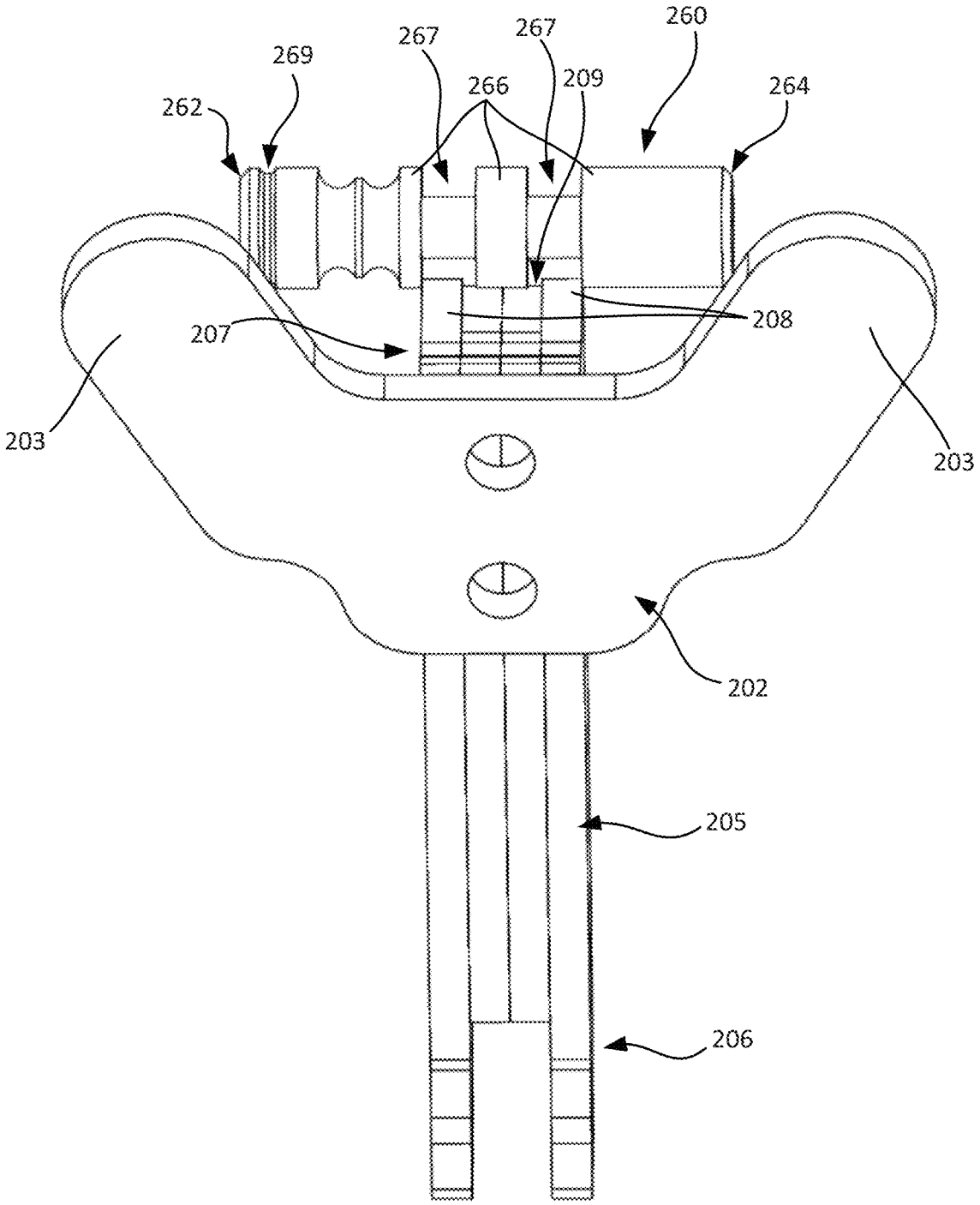
FIG. 3A illustrates a paddle trigger and paddle trigger safety, in accordance with various examples.
Figure 3B:
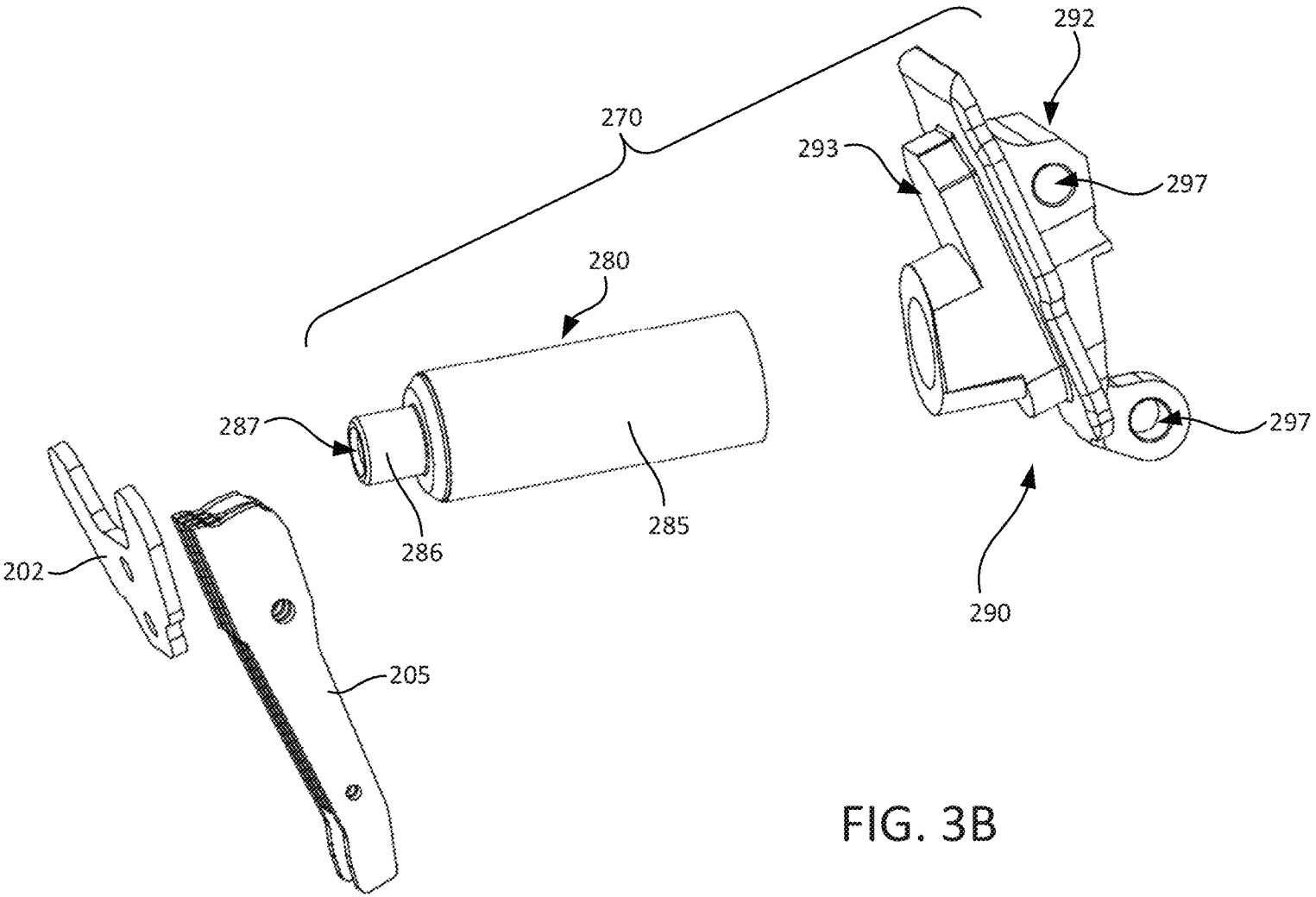
FIG. 3B illustrates a paddle trigger and related components, in accordance with various examples.
Figure 4A:
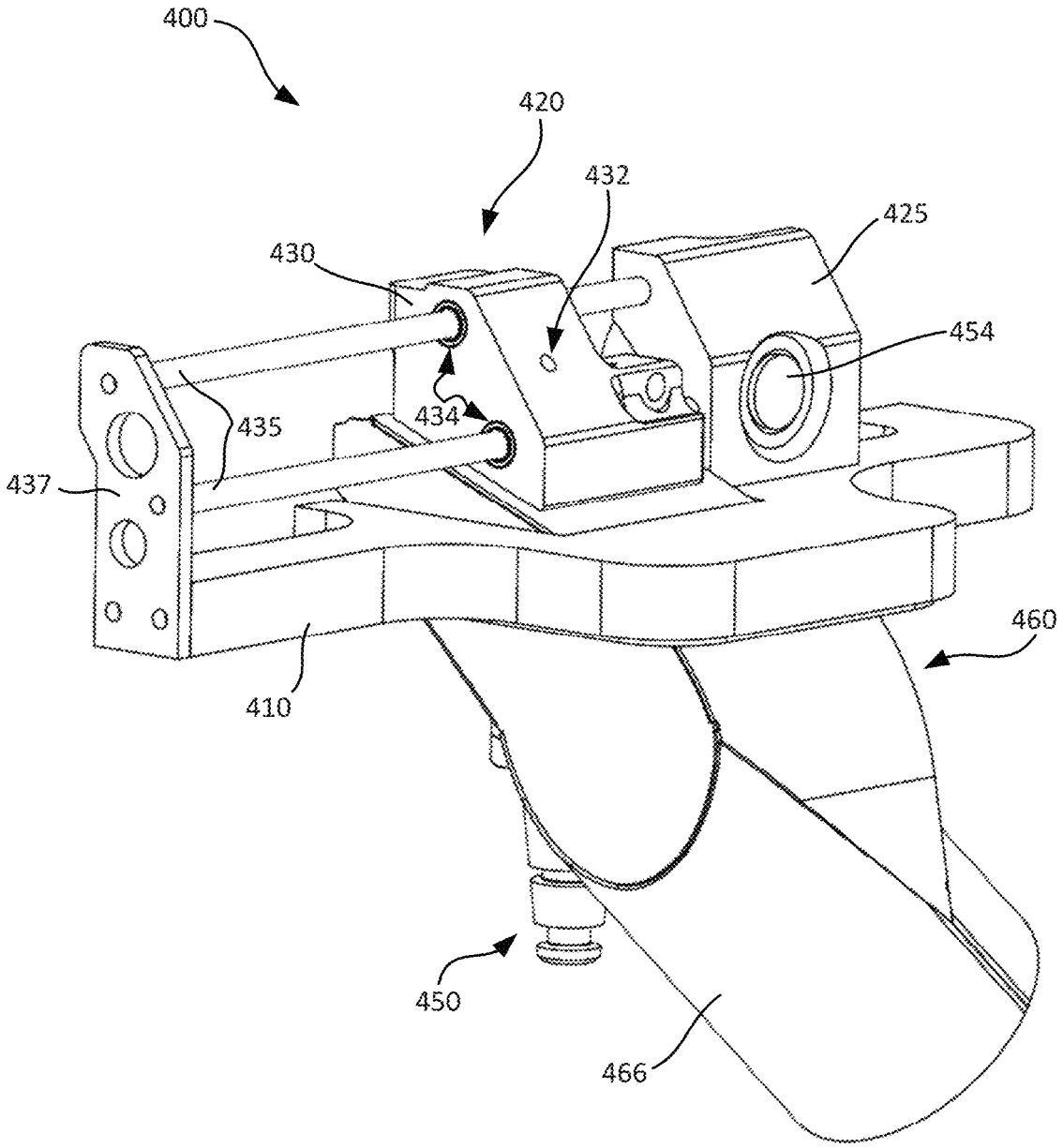
FIG. 4A illustrates a perspective view of a mounting system for the firearm spade grip assembly of FIG. 1B, in accordance with various examples.
Figure 4B:
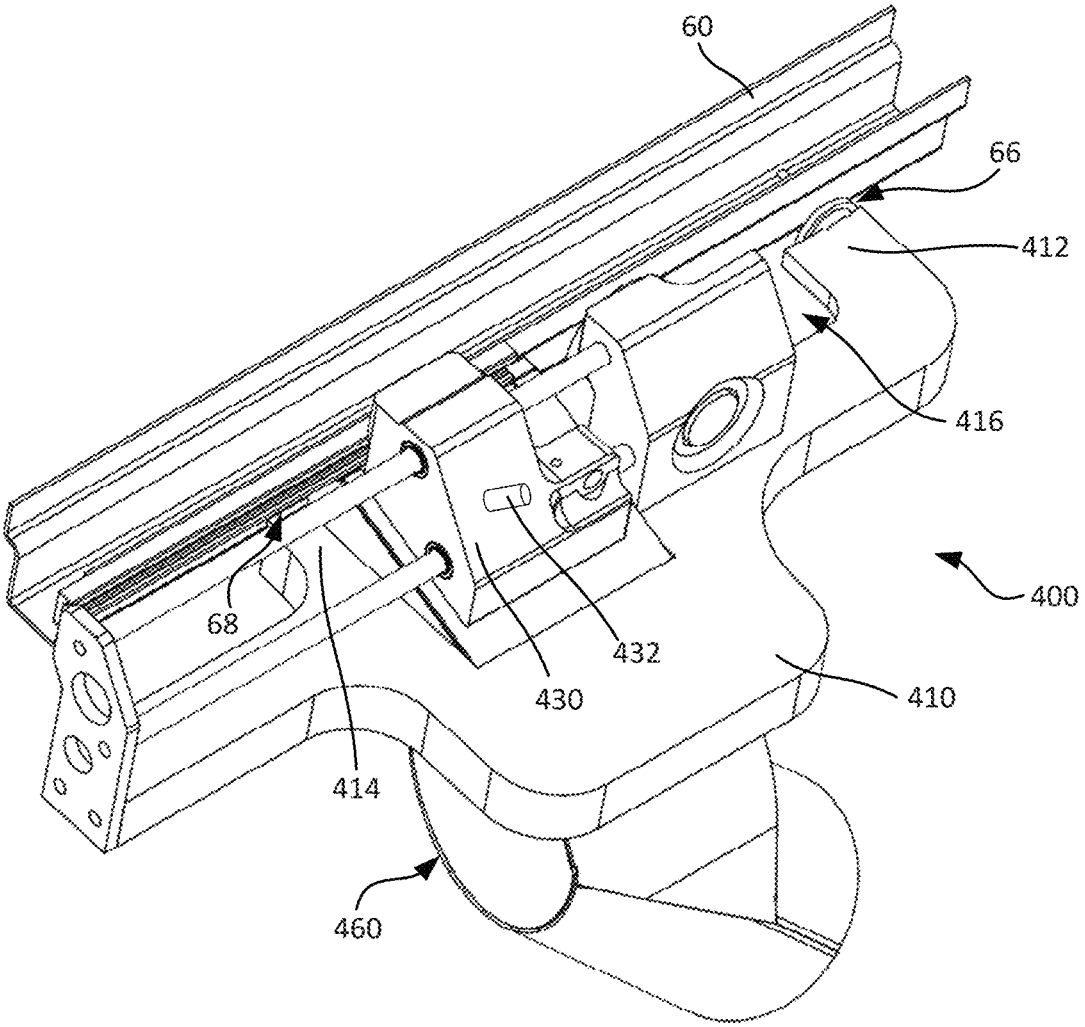
FIG. 4B illustrates another perspective view of the mounting system of FIG. 4A coupled to a firearm receiver base, in accordance with various examples.
Figure 4C:
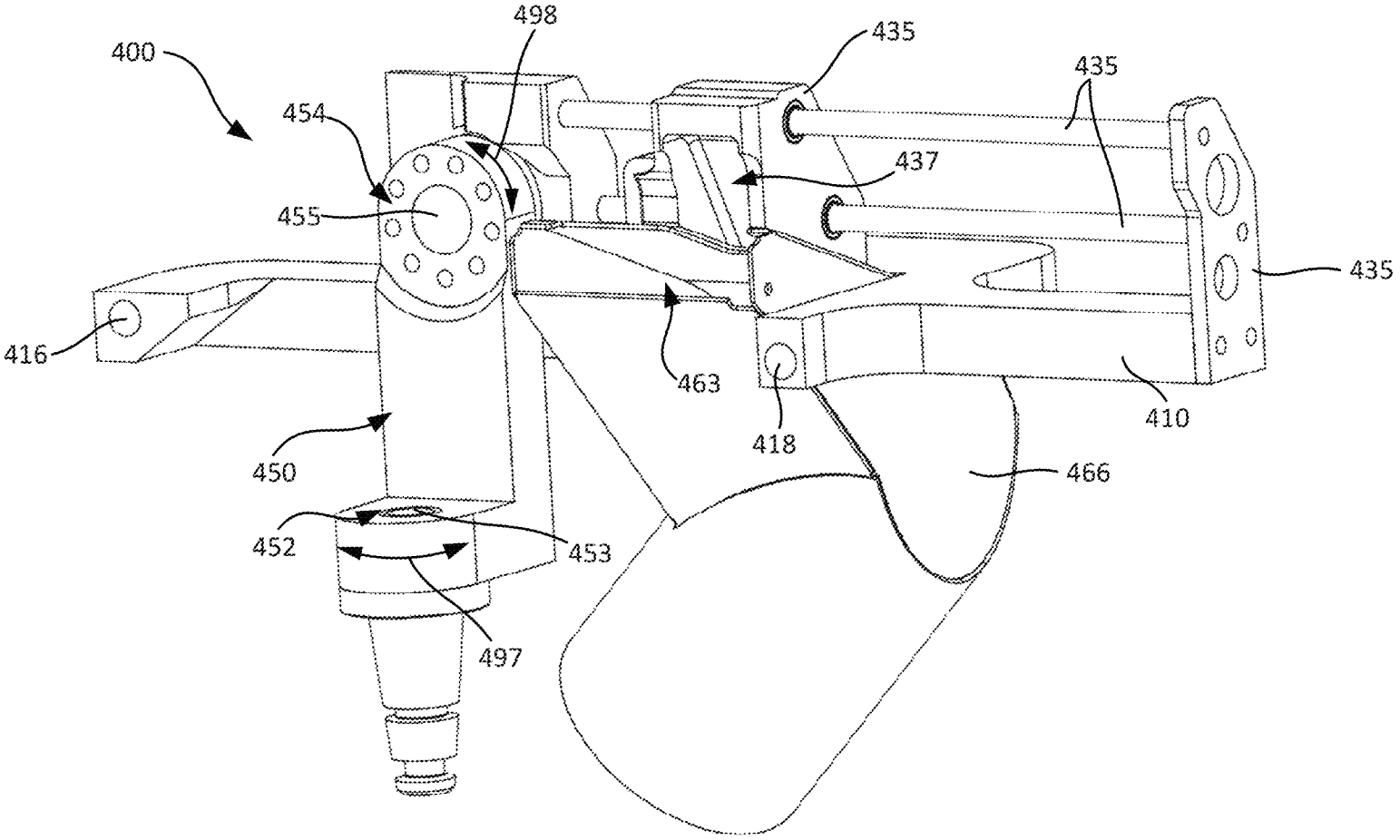
FIG. 4C illustrates a side view of the mounting system of FIG. 4A, in accordance with various examples.

In various examples, with additional reference to FIGS. 3A and 3B, paddle trigger 202 can be coupled to a paddle trigger bar 205. Paddle trigger bar 205 can be coupled to and/or at least partially disposed in paddle trigger housing 240. Paddle trigger 202 can be coupled to the trigger actuator (e.g., trigger actuator 650) by paddle trigger bar 205. During operation, in response to paddle trigger 202 being actuated (e.g., pressed in the forward direction), a top portion of paddle trigger bar 205 coupled to paddle trigger 202 can travel forward with paddle trigger 202, and paddle trigger bar 205 can pivot about a pivot point, such that a lower portion of paddle trigger bar 205 moves in an aft direction. Such lower portion of paddle trigger bar 205 can be coupled to the trigger actuator, such that in response to the lower portion of paddle trigger bar 205 moving in the aft direction, the trigger actuator moves in the aft direction therewith, actuating the firearm trigger.

In various examples, a paddle trigger assembly can have a paddle trigger safety configured to prevent an actuating movement of the paddle trigger and/or prevent actuation of the firearm trigger in response to movement of the paddle trigger. With continued reference to FIGS. 2A-2C and 3A, paddle trigger assembly 200 can comprise a paddle trigger safety 260 disposed in and/or coupled to paddle trigger housing 240. Paddle trigger safety 260 can comprise a rod having a first end 262 and a second end 264. Paddle trigger safety 260 can be disposed within and/or through paddle trigger housing 240 substantially perpendicular to the forward-at direction (in this context, "substantially" means plus or minus 30 degrees), such that, in response to being engaged, the paddle trigger safety 260 traverses the forward-aft path of travel of paddle trigger 202 and/or paddle trigger bar 205. Paddle trigger safety can be configured to be disposed through and protrude from side surfaces of paddle trigger housing 240, in various examples.

When unengaged, one side of the paddle trigger safety can protrude from a side surface of paddle trigger housing 240 (e.g., more than the other side). For example, as shown in FIGS. 2A-2C, first side 262 of paddle trigger safety 260 protrudes from the respective side surface of paddle trigger housing 240 to display a safety indicator 269. Safety indicator 269 may indicate whether paddle trigger safety 260 is engaged. For example, safety indicator 269 can comprise a color (e.g., red), which, when exposed by being external to paddle trigger housing 240, indicates that the firearm is ready to fire using paddle trigger assembly 200. Such an unengaged position of paddle trigger safety 260 can cause safety ridges 266 disposed on and radially protruding from the paddle trigger safety rod to be at least partially aligned with a paddle trigger channel 209 disposed in paddle trigger bar 205 and/or to be at least partially misaligned with paddle trigger 202 and/or paddle trigger bar 205. Similarly, the unengaged position of paddle trigger safety 260 can cause safety channels 267 to be at least partially aligned with paddle trigger ridges 208 disposed in paddle trigger bar 205. Therefore, the ridges and channels between paddle trigger 202/paddle trigger bar 205 and paddle trigger safety 260 can be complementary and disposed in a complementary manner when paddle trigger safety 260 is in the unengaged position, such that safety ridges 266 do not block movement of paddle trigger 202 and/or paddle trigger bar 205 (i.e., safety ridges 266), allowing movement of the trigger actuator and of the firearm trigger.

To engage paddle trigger safety 260, first side 262 of paddle trigger safety 260 can be pressed toward paddle trigger housing 240 such that paddle trigger safety 260 translates within paddle trigger housing 240. In response to such translation, first end 262 can be disposed close to, flush with, or within paddle trigger housing 240 (causing safety indicator 269 to be within paddle trigger housing 240 and out of sight from a user), and second side 264 of paddle trigger safety 260 can protrude further outside of paddle trigger housing 240 than when paddle trigger safety 260 is in the unengaged position. The absence of safety indicator 269 from view can indicate that paddle trigger safety 260 is engaged and the paddle trigger assembly 200 is in safe mode preventing or mitigating the risk of actuating the firearm trigger.

When engaged, such an engaged position of paddle trigger safety 260 can cause safety ridges 266 disposed on and radially protruding from the paddle trigger safety rod to be at least partially aligned with a paddle trigger ridges 208 disposed in paddle trigger bar 205. Similarly, the engaged position of paddle trigger safety 260 can cause at least one of safety channels 267 to be at least partially aligned with a paddle trigger channel 209 disposed in paddle trigger bar 205. Therefore, the ridges and channels between paddle trigger 202/paddle trigger bar 205 and paddle trigger safety 260 can be disposed when paddle trigger safety 260 is in the engaged position, such that safety ridges 266 block movement of paddle trigger 202 and/or paddle trigger bar 205 (i.e., safety ridges 266), preventing or mitigating the risk of movement of the trigger actuator and of the firearm trigger.

In various examples, a paddle trigger assembly can comprise a base. The base can be configured to couple to the receiver and/or buffer assembly of the firearm. The base can be the component of a paddle trigger assembly to which other components of a paddle trigger assembly couple to complete the assembly. For example, paddle trigger assembly 200 comprises base 210. Base 210 comprises a forward end 212 and an aft end 214. Actuator housing 230 (e.g., aft end 234 thereof) can be coupled to base forward end 212 and extend forward therefrom. In various examples, actuator housing 230 and base 210 can be separate components coupled together, or actuator housing 230 and base 210 can be one integral and/or monolithic component. Paddle trigger housing 240 can be coupled to base aft end 214. In various examples, paddle trigger housing 240 and base 210 can be separate components coupled together, or paddle trigger housing 240 and base 210 can be one integral and/or monolithic component. In various examples, a paddle trigger (e.g., paddle trigger 202) can be coupled directly to the base of the paddle trigger assembly (e.g., such that there is no separate paddle trigger housing), and other paddle trigger components (e.g., paddle trigger bar 205) can be disposed in and/or coupled to the base.

Paddle trigger housing 240 and/or actuator housing 230 can be coupled to base 210 in any suitable manner. For example, paddle trigger housing 240 and/or actuator housing 230 can be coupled to base 210 via tight fit, sliding paddle trigger housing 240 into aft end 214 of base 210 or sliding actuator housing 230 into forward end 212 of base 210 (e.g., by complementary rails), an adhesive, and/or a fastener(s)). For example, paddle trigger housing 240 can be coupled to aft end 214 of base 210 by sliding paddle trigger housing 240 downward on complementary rails between paddle trigger housing 240 and base aft end 214, and then securing such coupling by coupling top plate 249 to paddle trigger housing 240 and base aft end 214. Top plate 249 can be coupled to paddle trigger housing 240 and/or base 210 by fasteners (e.g., screws, bolts, rivets, pins, and/or the like).

The firearm to which paddle trigger assembly 200 couples can comprise a buffer assembly (e.g., buffer assembly 270 depicted in FIG. 3B). Buffer assembly 270 can be separate from a paddle trigger assembly, or can be considered a part of paddle trigger assembly (e.g, in response to buffer assembly 270 being coupled to base 210). Buffer assembly 270 can comprise a buffer tube 280 and a buffer plate 290. Buffer tube 280 can be coupled to buffer plate 290. For example, buffer tube 280 and buffer plate 290 can be fixedly coupled (e.g., as one integral and/or monolithic component). In various examples, base 210 can comprise a base cavity therein. Buffer tube 280 (depicted in FIG. 3B) can be disposed in the base cavity, e.g., as part of the coupling between the firearm (via buffer assembly 270) and paddle trigger assembly 200 (e.g., as depicted in FIG. 6A, buffer tube 680 disposed in base cavity 611). Buffer tube 280 can comprise a tube body 285 and a buffer protrusion 286. The tube body and the buffer protrusion can comprise different cross-sectional areas. For example, tube body 285 can comprise a circular cross-sectional area that is larger than a circular cross-sectional area of buffer protrusion 286. The cross-sectional areas of tube body 285 and tube body 285 can be concentric. The base cavity configured to receive buffer tube 280 can comprise a shape(s) and dimensions complementary to buffer tube 280. For example, the base cavity can comprise an aft section having a shape and dimensions complementary to those of buffer protrusion 286 and a main portion having shape and dimensions complementary to those of tube body 285. Buffer tube 280 can comprise a void disposed through an aft portion thereof (e.g., void 287 disposed through buffer protrusion 286), through which a fastener (e.g., a screw, bolt, or the like) can pass through to couple buffer tube 280 and/or buffer assembly 270 to base 210 of paddle trigger assembly 200. For example, as seen in FIG. 6A, fastener 691 is disposed through an aft surface of aft end of base 610 into buffer tube 680 to couple buffer tube 680 to base 610. Void 287 within buffer tube 280 can comprise threading complementary to the fastener configured to be received therein.

With reference to FIGS. 2A-2C and 3B, buffer plate 290 can be configured to couple to base forward end 212 of base 210. Base 210 can comprise a void in base forward end 212 (e.g., void 619 in the forward end of base 610 in FIG. 6A), which can have a shape complementary to buffer aft protrusion 293 (buffer aft protrusion 693 in FIG. 6A), in which buffer plate 290 can be disposed. For example, buffer tube 280 can be disposed in the base cavity as buffer plate 290 can be disposed in the void in base forward end 212 (the base cavity and void in base forward end 212 can be continuous and/or fluidly connected). Buffer plate 290 can be coupled to base forward end 212 in any suitable manner including by fastener (e.g., the fastener disposed through void 287 in buffer tube 280) and/or by tight fit within the void in base forward end 212.

Buffer plate 290 can provide a buffer forward surface with a buffer forward protrusion 292 extending therefrom. Buffer forward protrusion 292 can comprise a shape that is complementary to an aft void in a firearm receiver, such that the aft void of the firearm receives buffer forward protrusion 292, and forward protrusion 292 remains disposed therein. The shapes of buffer forward protrusion 292 and the aft void in the firearm can be complementary so as to limit movement of forward protrusion 292 within the firearm aft void laterally and/or radially.

In various examples, a buffer assembly can comprise one or more coupling apertures configured to aid in coupling the base and the paddle trigger assembly to a firearm. For example, as shown in FIG. 3B, buffer plate 290 can comprise buffer coupling voids 297 disposed through buffer forward protrusion 292 configured to align with firearm coupling apertures of the firearm in a firearm aft portion (e.g., an aft portion of a receiver). A fastener (e.g., a bolt, screw, fastening pin, buffer retainer pin, and/or the like) can be disposed through the buffer coupling voids 297 and the firearm coupling apertures to couple the base to the firearm (via buffer assembly 270). That is, base 210 can be coupled to buffer assembly 270, as discussed herein, and then buffer plate 290 of buffer assembly 270 can be coupled to the firearm via buffer coupling voids 297. In various examples, such a protrusion comprising a base coupling aperture can be coupled to, or integral and/or monolithic with, a forward surface of the base.

In various examples, with additional reference to FIGS. 6A and 6B, buffer coupling voids 297 can be disposed through buffer forward protrusion 292 in a direction substantially perpendicular to the forward-aft direction (in this context, "substantially" means plus or minus 30 degrees). Firearm coupling apertures 697 disposed through the firearm receiver can be positioned complementary to the positions of buffer coupling apertures 297, such that, in response to buffer forward protrusion 292 being disposed in firearm aft void 689, buffer coupling apertures 297 of buffer plate 290 (buffer plate 690 in FIGS. 6A,B) can be aligned with the firearm coupling apertures 697. In response, fasteners 696 (e.g., buffer retainer pins) can be disposed through buffer coupling voids 297 and the firearm coupling apertures 697. For example, retaining pins can be disposed therethrough, similar to takedown pins holding the upper and lower receivers together in an AR-15 style rifle. The retaining pins can maintain their respective positions when installed in any suitable manner, such as by tight fit, a component with radially-outward spring force configured to retain the fasteners in place, and/or the like.

Without the presence of paddle trigger assembly 200, buffer assembly 270 can be coupled to the firearm, and a firearm stock can be coupled to the buffer assembly 270. For example, a stock can comprise a void in a stock forward end in fluid communication with a stock cavity disposed within the stock. The void in the stock forward end can have a shape complementary to, and be configured to receive, buffer aft protrusion 293, in which buffer plate 290 can be disposed. Buffer plate 290 can be coupled to the stock forward end in any suitable manner including by fastener (e.g., the fastener disposed through void 287 in buffer tube 280) and/or by tight fit within the void in the stock forward end. For example, buffer tube 280 can be disposed in the stock cavity as buffer plate 290 can be disposed in the void in stock forward end. The stock cavity can be configured to receive buffer tube 280, and a fastener can be disposed through an aft surface of the stock and into void 287 of buffer tube 280. Accordingly, paddle trigger assembly 200 can be retrofitted to a firearm from the original equipment manufacturer by, for example, decoupling the firearm stock from buffer assembly 270 and coupling paddle trigger assembly 200 to buffer assembly 270, as discussed herein.

In various examples, a paddle trigger assembly can comprise one or more handles for a user to grip. A handle can be disposed in an aft portion of the paddle trigger assembly, or aft of the actuator housing, traverse block, base, and/or paddle trigger, and/or the handle can be the aft-most component of a paddle trigger assembly. For example, in paddle trigger assembly 200, handles 295 are the aft-most components. A handle 295 (also called a "spade grip") can be disposed to the side of, or laterally spaced from, an axis along which the components of paddle trigger assembly 200 span (e.g., an axis parallel to the axis of a firearm barrel). In paddle trigger assembly 200, with two handles 295, paddle trigger 202 and other components of paddle trigger assembly 200 can be disposed between handles 295. Paddle trigger 202 can be disposed between handles 295 such that a user can grip handles 295 and engage paddle trigger 202 with the users' thumbs.

Handles in a paddle trigger assembly can be coupled thereto in any suitable manner. For example, handles 295 are coupled to base 210 by brackets 274. A top bracket 274 can be coupled to a top surface of base 210. A bottom bracket 274 can be coupled to a bottom surface of base 210. Brackets 274 can be U-shaped or V-shaped to allow coupling of two handles 295—one on either side of paddle trigger 202. In various examples, the handles and/or brackets for coupling the handles can be coupled to any suitable component of a paddle trigger assembly.

As discussed herein, paddle trigger 202 is coupled to an aft surface of base 210 and/or paddle trigger housing 240 and disposed in a substantially vertical position such that paddle trigger 202 is engaged by pressing paddle trigger 202 in the forward direction, and disengaged by the paddle trigger 202 moving in the aft direction. However, the paddle trigger can be disposed in any suitable position on a paddle trigger assembly and engaged in any suitable manner or direction. For example, a paddle trigger can be disposed in a substantially horizontal position (facing upward or downward), engagement of which can occur by pressing the paddle trigger upward or downward. In various examples, the paddle trigger can be coupled to a top surface or a bottom surface of the base and/or paddle trigger housing. In various examples, the paddle trigger can face one side (rather than aft-ward, upward, or downward) and be engaged by pressing the paddle trigger to one side. In various examples, the paddle trigger can be coupled to a side surface of the base and/or paddle trigger housing. The paddle trigger can be disposed in any suitable position to allow engagement thereof by a user.

With reference to FIGS. 1B and 4A-4C, spade grip assembly 100 can further comprise a mounting system 400. Mounting system 400 can comprise a mounting support arm 450 configured to couple and mount the firearm to the surface (e.g., on a platform, vehicle, and/or the like). The firearm can be coupled to any suitable component of a mounting system to allow movement and aiming of the firearm.

A mounting support arm can comprise one or more joints configured to allow the firearm to pivot thereabout to aim the firearm in different directions. For example, the mounting support arm can comprise or be coupled to a ball joint about which the firearm can pivot in vertical, horizontal, and diagonal directions at any suitable angle. As another example, mounting support arm 450 can comprise two joints, foundation joint 452 and mount joint 454. Foundation joint 452 can be configured to allow the firearm to pivot and/or move about a first pivot point 453 (e.g., in a substantially horizontal direction 497). Mount joint 454 can be configured to allow the firearm to pivot and/or move about a second pivot point 455 (e.g., in a substantially vertical direction 498) (as used in this context, "substantially" means plus or minus 30 degrees).

In various examples, mounting system 400 can comprise a mounting base 410 to which the firearm can couple (e.g., by firearm receiver base 60 coupling to mounting base 410). Mounting plate 410 can comprise mounting arms 412, 414 protruding from a side of mounting base 410, to which the firearm can couple. The extension of mounting arms 412, 414 from the side of mounting base 410 can create a mounting base void 416, providing clearance for the mounting support arm 450 between mounting base 410 and the firearm, as well as clearance for other components of mounting system 400 (e.g., charging block 420, discussed herein). Mounting arms 412, 414 can be spaced and positioned, and can comprise mounting apertures 416 and 418, complementary to firearm mounting apertures 66 and 68 in firearm receiver base 60. Accordingly, in response to mounting arms 412, 414 and mounting apertures 416, 418 being aligned with firearm mounting apertures 66 and 68, fasteners (e.g., bolts, screws, rivets, retaining pins, and/or the like) can be disposed therethrough, coupling the firearm (e.g., by firearm receiver base 60) to mounting base 450 and/or mounting system 400. Mounting base 450 can be coupled to the firearm such that mounting base 450 moves and pivots with the firearm as the firearm is moved and aimed via the joint(s) comprised in the mounting system.

In various examples, a mounting system can comprise a charging system coupled to the mounting base and/or mounting support arm. The components of a firearm spade grip assembly can create difficulty for a user to reach and/or operate the charging handle or system of the firearm because of such components causing obstructions to the firearm charging handle and/or the charging motion. Accordingly, the charging system can be configured to aid the user of the firearm of the firearm spade grip assembly in charging the firearm by providing a more convenient gripping point, angle, and/or movement to charge the firearm.

For example, charging system 420 of mounting system 400 can comprise a charging block 430 configured to couple to and/or engage the firearm charging handle. Charging block 430 can comprise a charging handle receptacle 437, which can be a void disposed in charging block 430. The firearm charging handle can be disposed in charging handle receptacle 437 such that, in response to charging block 430 being translated, the firearm charging is translated therewith, charging the firearm.

In various examples, charging block 430 can comprise one or more guiderail channels, through which guiderails can be disposed. Charging system 420 can comprise guiderails 435 disposed through the guiderail channels in charging block 430, along which charging block 430 can translate to charge the firearm. Guiderails in a mounting system can be coupled to and between two points in the mounting system 400. For example, guiderails 435 can be coupled to and between mounting support arm 450 (e.g., via mounting joint block 425 (e.g., in which mount joint 454 can be housed)) and mounting base 410 (e.g., via mounting bracket 437 coupled to and extending from mounting base 410). Mounting system 400 can comprise two guiderails 435 to stabilize charging block 430 within a two-dimensional or three-dimensional space.

In various examples, mounting system 400 can comprise a charging block handle 432 coupled to and extending from charging block 430 to facilitate gripping of and moving charging block 430 to charge the firearm.

In various examples, a mounting system can comprise a brass catch configured to receive and direct expended brass casings ejected from the firearm resulting from firing the firearm. For example, mounting system 400 can comprise brass catch 460. Brass catch 460 can comprise a brass catch inlet 463, which may be disposed at a position complementary to the firearm ejection port in response to the firearm being coupled to mounting system 400 (e.g., via mounting base 410). Brass catch inlet 463 can be position such that, in response to an expended brass casing from a fired firearm cartridge being ejected through the firearm ejection port, brass catch 460 receives the expended brass casing through brass catch inlet 463. Brass catch 460 can further comprise a brass catch chute 466 comprising a channel disposed therethrough that is in fluid communication with brass catch inlet 463. Accordingly, expended brass casings can enter brass catch 460 through brass catch inlet 463 and be directed to a desired location through brass catch chute 466 (e.g., into a brass receptacle or bin, or disposed in a desired direction from the firearm spade grip assembly).

Figure 5:
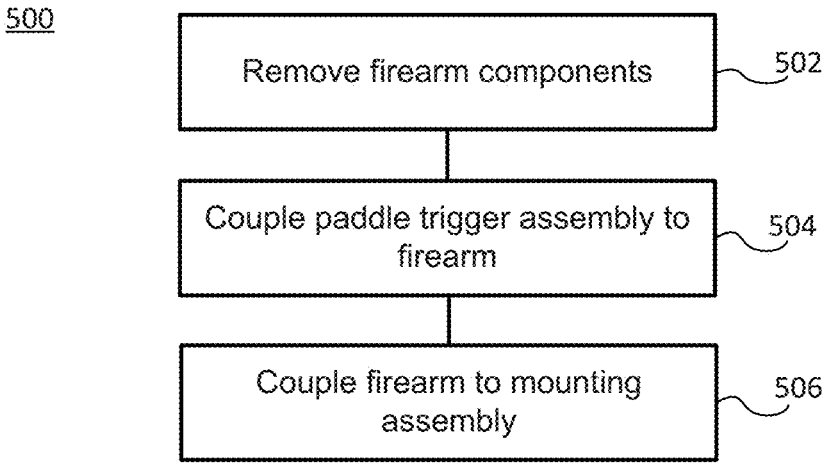
FIG. 5 illustrates a method for assembling a firearm spade grip assembly, in accordance with various examples.

FIG. 5 depicts a method 500 for assembling a firearm spade grip assembly. To retrofit components of a firearm spade grip assembly to an existing firearm, certain firearm components can be removed from the firearm (step 502). For example, the firearm handle, trigger guard, and/or buttstock can be removed from a firearm. The handle and/or trigger guard can be removed by removing a firearm handle fastener from the handle (e.g., from the bottom of the firearm handle), which couples the firearm handle and/or trigger guard to firearm receiver base 60. Removing the trigger guard, if separate from the firearm handle, can comprise removing separate fasteners from the firearm handle fastener. The buttstock can be removed by removing a fastener coupling the buttstock to the rest of the firearm (e.g., the firearm receiver and/or buffer assembly). For example, the buttstock can be removed by removing a fastener disposed through the buttstock coupling the buttstock to buffer tube 280 (as discussed herein).

With additional reference to FIGS. 6A and 6B, in response to removing the firearm components from the firearm in step 502, the paddle trigger assembly of a spade grip assembly can be coupled to the firearm. As discussed herein, paddle trigger assembly 200 can be coupled to the firearm (step 504). For example, base 210 (e.g., base 610) of paddle trigger assembly 200 can be coupled to firearm 615 (e.g., via the firearm receiver and/or a buffer assembly), as discussed herein. For example, buffer aft protrusion 693 can be inserted into void 619 in the forward end of base 610, and forward protrusion 292 of buffer plate 290 can be inserted into the receiver, aligning coupling apertures 297 with firearm coupling apertures 697 disposed through the firearm receiver (that may have previously been used to retain the buttstock), and disposing a fastener therethrough. As another example, as discussed herein, actuator housing 630 can be coupled to the firearm (e.g., via the firearm receiver, firearm receiver base 60 (660 in FIGS. 6A,B), and/or firearm trigger housing 672), by inserting a fastener 698 through a coupling void 242 (642 in FIGS. 6A,B) disposed in a bottom surface 236 of actuator housing 230 (630 in FIGS. 6A,B). The fastener (e.g., a screw or bolt) can pass through actuator housing 230 and be disposed in a firearm coupling void (e.g., firearm coupling void 699), for example, in trigger housing 672, firearm receiver base 660, and/or the firearm receiver. Thus, the actuator housing and/or paddle trigger assembly can be coupled to the firearm.

Further to coupling the firearm to the firearm spade grip assembly, the firearm can be coupled to mounting assembly 400 (step 506). The firearm receiver and/or firearm receiver base 60 can be coupled to any suitable component of mounting assembly 400. For example, the firearm receiver and/or firearm receiver base 60 can be coupled to mounting base 410 at mounting arms 412, 414, e.g., by aligning mounting apertures 416, 418 with firearm mounting apertures 66 and 68, and inserting and coupling/securing fasteners (e.g., bolts, screws, rivets, retaining pins, and/or the like) therethrough.

The paddle trigger assemblies and methods herein can allow the coupling or retrofitting of a system having a paddle trigger and spade grip to a firearm from the original equipment manufacturer without manipulation or adjustment of the action or fire and/or trigger control group of the firearm.

As will be appreciated, the spade grip systems and methods described herein maybe adapted to any desired or suitable firearm, such as firearms of different makes, models, sizes, calibers, and/or configurations.

Benefits, other advantages, and solutions to problems have been described herein with regard to specific example. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" or "at least one of A, B, and C" is used in the claims or specification, it is intended that the phrase be interpreted to mean that A alone may be present in an example, B alone may be present in an example, C alone may be present in an example, or that any combination of the elements A, B and C may be present in a single example; for example, A and B. A and C, B and C, or A and B and C. Different cross-hatching may be used throughout the figures to denote different parts but not necessarily to denote the same or different materials.

Systems, methods and apparatus are provided herein. In the detailed description herein, references to "one example", "an example", "various examples", etc., indicate that the example described may include a particular feature, structure, or characteristic, but every example may not necessarily include the particular feature, structure, or characteristic. Moreover, such phrases are not necessarily referring to the same example. Further, when a particular feature, structure, or characteristic is described in connection with an example, it is submitted that it is within the knowledge of one skilled in the art to affect such feature, structure, or characteristic in connection with other examples whether or not explicitly described. After reading the description, it will be apparent to one skilled in the relevant art(s) how to implement the disclosure in alternative examples.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A firearm spade grip assembly, comprising:

a paddle trigger assembly, comprising:

a base spanning between and comprising a base forward end and a base aft end;

a paddle trigger coupled to the base;

a trigger actuator coupled to the base, wherein a portion of the trigger actuator extends from the base forward end, wherein the trigger actuator comprises an actuator aft end coupled to the paddle trigger and a traverse block forward of the actuator aft end configured to engage and pull a firearm trigger of a firearm in an aft direction in response to translation of the trigger actuator, wherein movement of the paddle trigger is configured to translate the trigger actuator; and an actuator housing coupled to and extending forward from the base, wherein the trigger actuator is disposed at least partially within the actuator housing.

2. The assembly of claim 1, wherein the actuator housing is configured to couple to at least one of a firearm receiver base or a firearm receiver of the firearm.

3. The assembly of claim 1, wherein the actuator housing is configured to receive a firearm trigger of the firearm therein.

4. The assembly of claim 1, further comprising a fastener disposed through a bottom surface of the actuator housing that is configured to couple the actuator housing to the firearm.

5. The assembly of claim 4, wherein the fastener is configured to be disposed in a handle fastener receptacle in the firearm.

6. The assembly of claim 1, further comprising a paddle trigger housing coupled to the base aft end, wherein the paddle trigger is coupled to the base via the paddle trigger housing.

7. The assembly of claim 1, wherein the base forward end comprises a void configured to receive a buffer assembly of the firearm.

8. The assembly of claim 1, further comprising a paddle trigger safety configured to prevent an actuating movement of the paddle trigger in response to being engaged.

9. The assembly of claim 1, further comprising a mounting system configured to couple the firearm to a surface.

10. The assembly of claim 9, wherein the mounting system comprises a mounting base configured to couple to a firearm receiver base or a firearm receiver of the firearm.

11. The assembly of claim 10, wherein the mounting system further comprises a charging system coupled to the mounting base and comprising a charging block configured to couple to a charging handle of the firearm and a guiderail configured to allow the charging block to translate in the aft direction or a forward direction to charge the firearm.

12. The assembly of claim 10, wherein the mounting system further comprises a brass catch coupled to the mounting base comprising a brass catch inlet and a brass catch chute, wherein the brass catch inlet is configured to align with an ejection port of the firearm, and wherein the brass catch inlet and the brass catch chute are in fluid communication.

13. The assembly of claim 10, wherein the mounting system further comprises a mounting support arm configured to support the mounting system, wherein the mounting support arm comprises a foundation joint and a mount joint, wherein the foundation joint is configured to allow the firearm to move about a first pivot point, and wherein the mount joint is configured to allow the firearm to move about a second pivot point.

14. A firearm spade grip assembly, comprising:

a firearm comprising at least one of a firearm receiver base or a firearm receiver, and a firearm trigger; and a paddle trigger assembly coupled to the firearm, comprising:

a base, comprising a base forward end and a base aft end, wherein the base is coupled to an aft end of the firearm receiver base or an aft end of the firearm receiver;

a paddle trigger coupled to the base;

a trigger actuator coupled to the paddle trigger and configured to actuate the firearm trigger in response to movement of the paddle trigger; and an actuator housing coupled to and extending forward from the base, wherein the actuator housing is coupled to the firearm receiver base or the firearm receiver such that the firearm trigger of the firearm is disposed at least partially in the actuator housing.

15. The assembly of claim 14, wherein the firearm trigger is completely enclosed between the firearm and the actuator housing.

16. The assembly of claim 14, wherein the paddle trigger assembly is coupled to the firearm at least partially by a fastener disposed through a bottom surface of the actuator housing and into a handle fastener receptacle in the firearm.

17. The assembly of claim 14, further comprising a buffer assembly coupled to the firearm receiver, wherein the base forward end is coupled to the buffer assembly.

18. The assembly of claim 14, further comprising a mounting system coupled to the firearm and configured to couple the firearm to a surface, wherein the mounting system comprises a mounting support arm comprising a foundation joint and a mount joint, wherein the foundation joint is configured to allow the firearm to move about a first pivot point, and wherein the mount joint is configured to allow the firearm to move about a second pivot point.

* * * * *